United States Patent [19]

Johnson

[11] 4,275,797

[45] Jun. 30, 1981

[54] SCAFFOLDING POWER ATTACHMENT

[76] Inventor: Raymond R. Johnson, P.O. Box 964, Wenatchee, Wash. 98801

[21] Appl. No.: 33,908

[22] Filed: Apr. 27, 1979

[51] Int. Cl.[3] ..... B60K 7/00; E04G 1/20

[52] U.S. Cl. ..... 180/2 R; 180/13; 180/65 R; 182/16; 192/97

[58] Field of Search ..... 180/2 R, 11, 12, 13, 180/252, 140, 65 R; 182/13, 16, 17; 16/35 R; 192/95, 97

[56] References Cited

U.S. PATENT DOCUMENTS

| | | | |
|---|---|---|---|
| 1,157,408 | 10/1915 | Master | 192/95 |
| 2,513,718 | 7/1950 | Gfrorer | 180/13 |
| 3,232,375 | 2/1966 | Warthen | 182/13 |
| 3,256,954 | 6/1966 | Warthen | 182/16 |
| 3,520,382 | 7/1977 | Halsey et al. | 182/13 |
| 3,865,203 | 2/1975 | Hibma | 180/2 |
| 3,930,548 | 1/1976 | Wallraff | 180/6.5 |

*Primary Examiner*—John J. Love
*Assistant Examiner*—Donn McGiehan
*Attorney, Agent, or Firm*—Roy E. Mattern, Jr.

[57] ABSTRACT

A power unit for attachment to scaffolding towers such as commonly used for overhead work in the installation of wiring, ductwork, painting, and finishing. A single power unit attached to one leg of a scaffolding tower can move, about the worksite, a large scaffolding tower assembly comprised of one or more individual scaffolding towers. Two power units working in tandem on separate legs of the scaffolding tower assemblage, provides increased maneuverability. Each power unit has separate motors to drive and to change the direction of a scaffolding tower assembly. One electric motor pivots the power unit about the scaffolding tower leg to which it is attached, thereby changing the direction of motion of the scaffolding tower assembly. Another electric motor of the power unit provides power to a drive wheel of the power unit, and consequently moves the scaffolding tower assembly. A brake prevents rotation of the drive wheel when the power unit is not in operation, thereby keeping the scaffolding tower assembly in one location. A clutch within the drive wheel mounting allows the scaffolding to be manually freewheeled about without interference from the scaffolding power unit. A power cord and an electrical control cable with a control console may be extended to any length for remote control of the scaffolding power unit and when not in use may be coiled within the unit for convenient storage.

7 Claims, 8 Drawing Figures

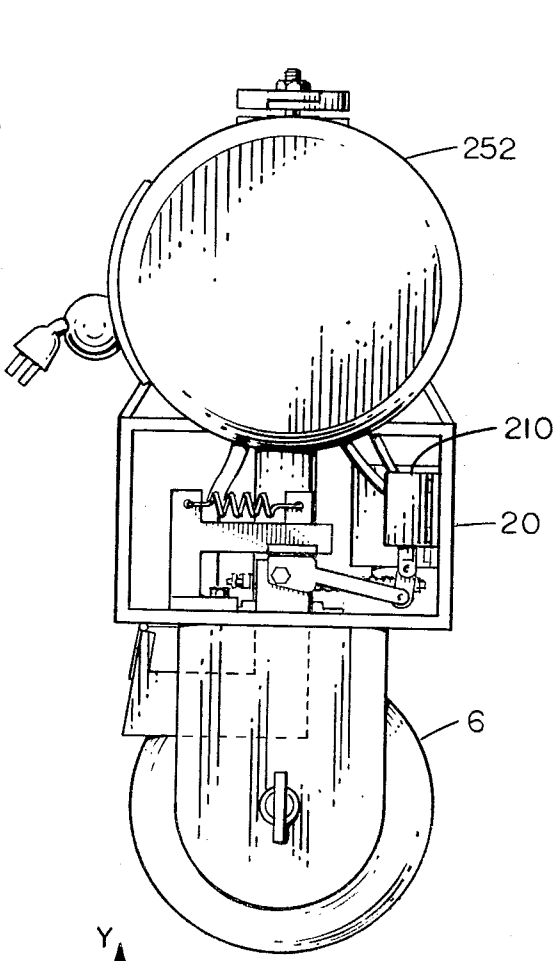
3B
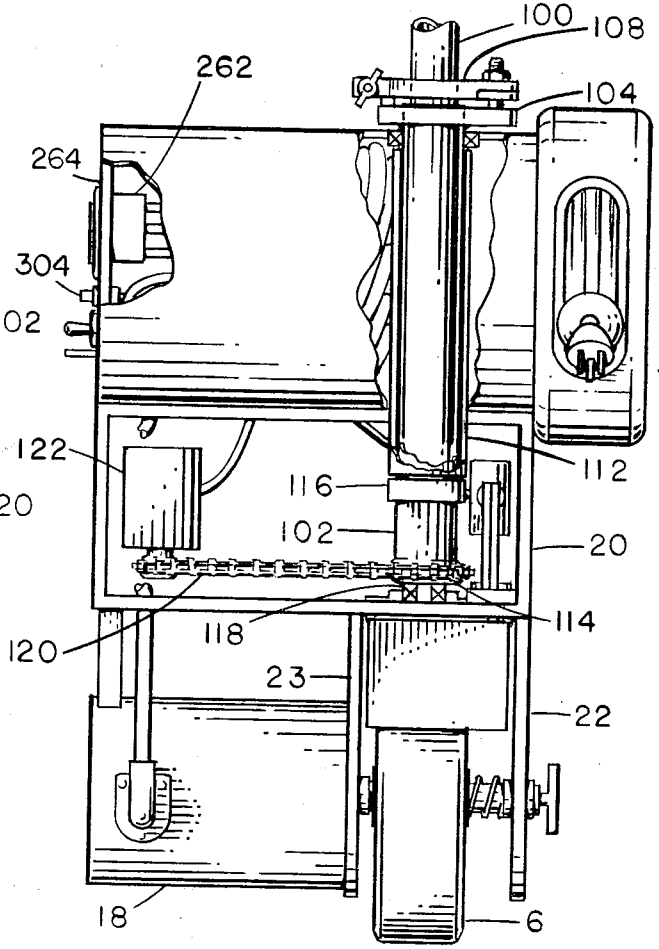
3
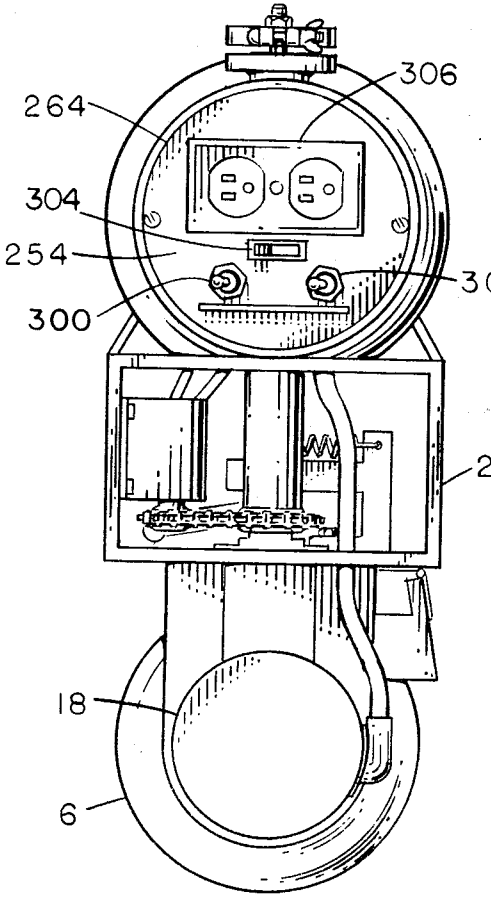
3A

SCAFFOLDING POWER ATTACHMENT

BACKGROUND OF THE INVENTION

Overhead work, such as wiring, ductwork, painting, etc. often requires the assemblage of scaffolding towers to provide a platform for a worker or workers. Once assembled, these scaffold towers are often difficult to move from place to place, requiring either a worker dismounts the scaffold and pushes it himself, or that another worker be stationed below for this scaffold moving job.

In contrast this power unit for attachment to scaffolding assemblies allows a worker to remain aloft on the scaffolding, while controlling the movement of the scaffold assembly about the worksite. This scaffolding power unit is easily attached and easily removed from a scaffold assembly. At least two other castering wheels of a scaffolding subassembly are kept from pivoting, by a removable locking subassembly quickly installed on each castering wheel, to increase the steering effectiveness of this power unit. If the power units are used in tandem, to provide increased maneuverability, the locking subassemblies are unnecessary.

Past power units for scaffolding towers, which have been attached to the rear portions of scaffolding framework and have a front steering wheel are disclosed in U.S. Pat. Nos. 3,256,954, and 3,232,375. In U.S. Pat. No. 3,520,382 is a hand driven scaffold. In U.S. Pat. No. 3,930,548 two drive units are disclosed with a stabilizing bar connected between them. The prior motorized attachments for scaffolding towers are often more difficult and time consuming to attach; are often of limited traction due to their mounting methods; often require a special type of scaffolding tower, thereby limiting their versatility; and also often obstruct the area between the legs of the scaffolding such that building materials and other possible items cannot be passed between the scaffolding legs, consequently making the scaffolding tower assembly more difficult to move about to new positions.

SUMMARY OF THE INVENTION

This scaffolding power unit includes both a drive means and a steering means in one compact power unit to be removably mounted on a single leg of a scaffolding assembly. Two power units may be mounted on separate legs for increased maneuverability. By replacing a wheel of the scaffolding tower assembly with the power unit, this method of attachment insures that sufficient traction is always available to the drive wheel, since part of the weight of the scaffolding tower is automatically distributed to the drive wheel of the power unit. If more weight is added to the scaffolding tower, thereby requiring more traction from the drive wheel, the added weight automatically provides the basis for the needed traction. Also the operator of the power unit may position himself on the scaffolding platform directly above the power unit, thereby increasing traction by placing most of his weight on the drive wheel.

As an additional consequence of this mounting means, there is no need for any lower cross connection between the legs of the scaffolding assembly which otherwise would obstruct the passage of objects, i.e. building materials, tools, commonly found in the work area making the movement of the scaffolding tower very difficult.

This power unit is installed using only one fastener assembly. In attaching the power unit, a caster wheel on one scaffolding leg is removed, and then the power unit is secured to this scaffolding leg using an inner pipe of the power unit, which is rotatably connected to a directional motor. This inner pipe rotatably fits inside an outer pipe also of the power unit, which is permanently attached to the mounting of the driving motor. Steering occurs when a directional motor tries to turn the inner pipe which is secured to the scaffolding tower leg, and by the reaction provided by the scaffolding tower, the power unit is caused to rotate about the scaffolding tower, due to its smaller moment and frictional coefficient. Control switches are respectively connected to the drive and directional motors by control cables that may be extended to any length. Often these control cables extend to the height of the scaffold assemblies for operation by a workman who remains on the elevated working platform. Electric power leads are often also included with these control cables and connected to convenient electrical outlets for electric hand tools being used by the workman on the elevated platform of the scaffold assembly. Storage drums are provided for both the remote control electrical cables and the electrical power outlet cables. A brake assembly automatically locks the drive wheel when the power unit is not in operation thereby locking the scaffolding assembly. A clutch in the hub of the drive wheel allows the power unit to become freewheeling and to then allow the scaffolding tower to be pushed about manually, for example when there might be an electrical power failure caused by a storm.

DESCRIPTION OF THE DRAWINGS

FIG. 3 is a front sectional view of this scaffolding power unit.

FIG. 3*a* is a left end view of the scaffolding power unit.

FIG. 3*b* is a right end view of the scaffolding power unit.

DETAILED DESCRIPTION OF THE PREFERRED EMBODIMENTS

Figure 1:
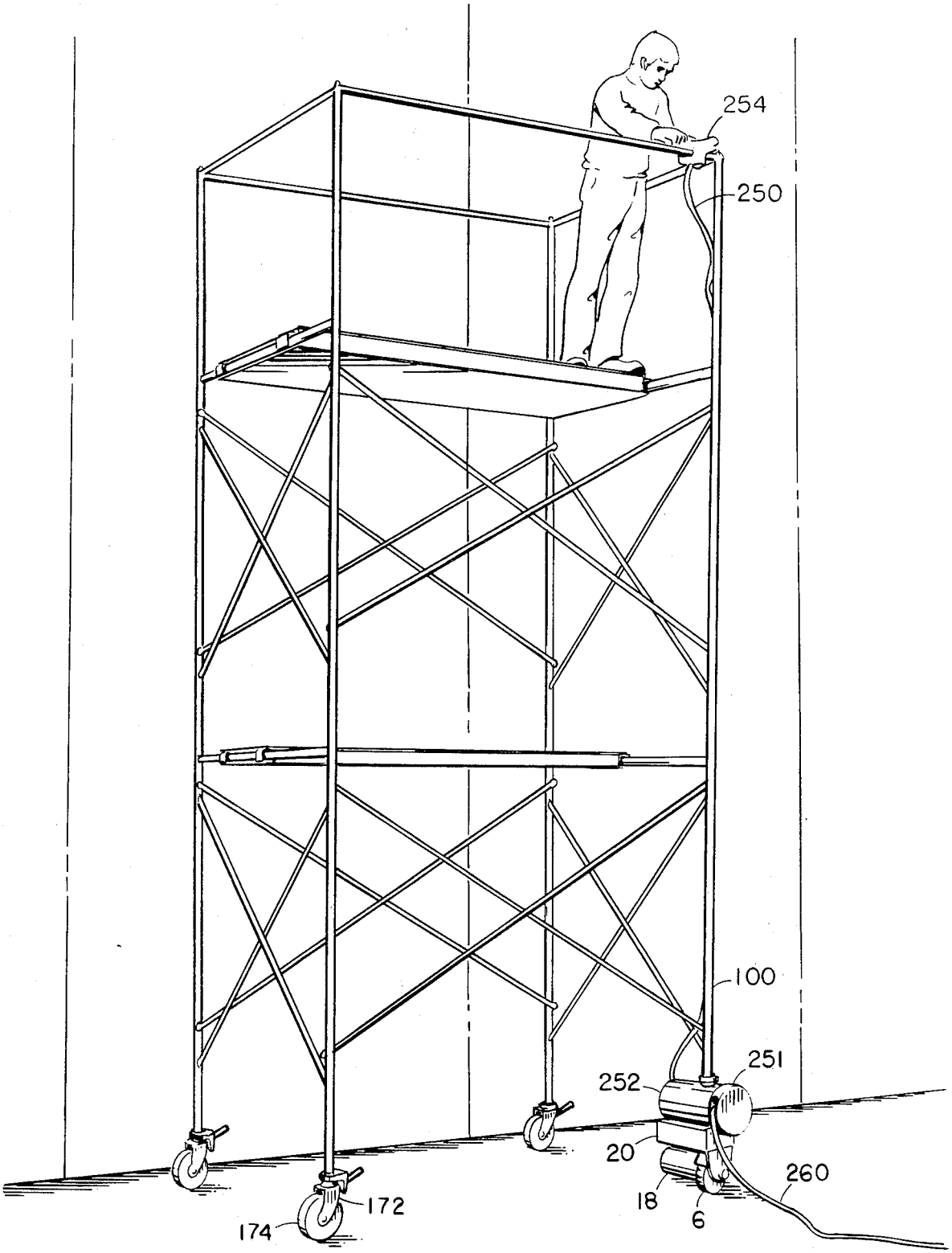
FIG. 1 is a perspective view of the preferred embodiment scaffolding power unit as it operates in combination with a standard scaffolding tower assembly.
Figure 2:
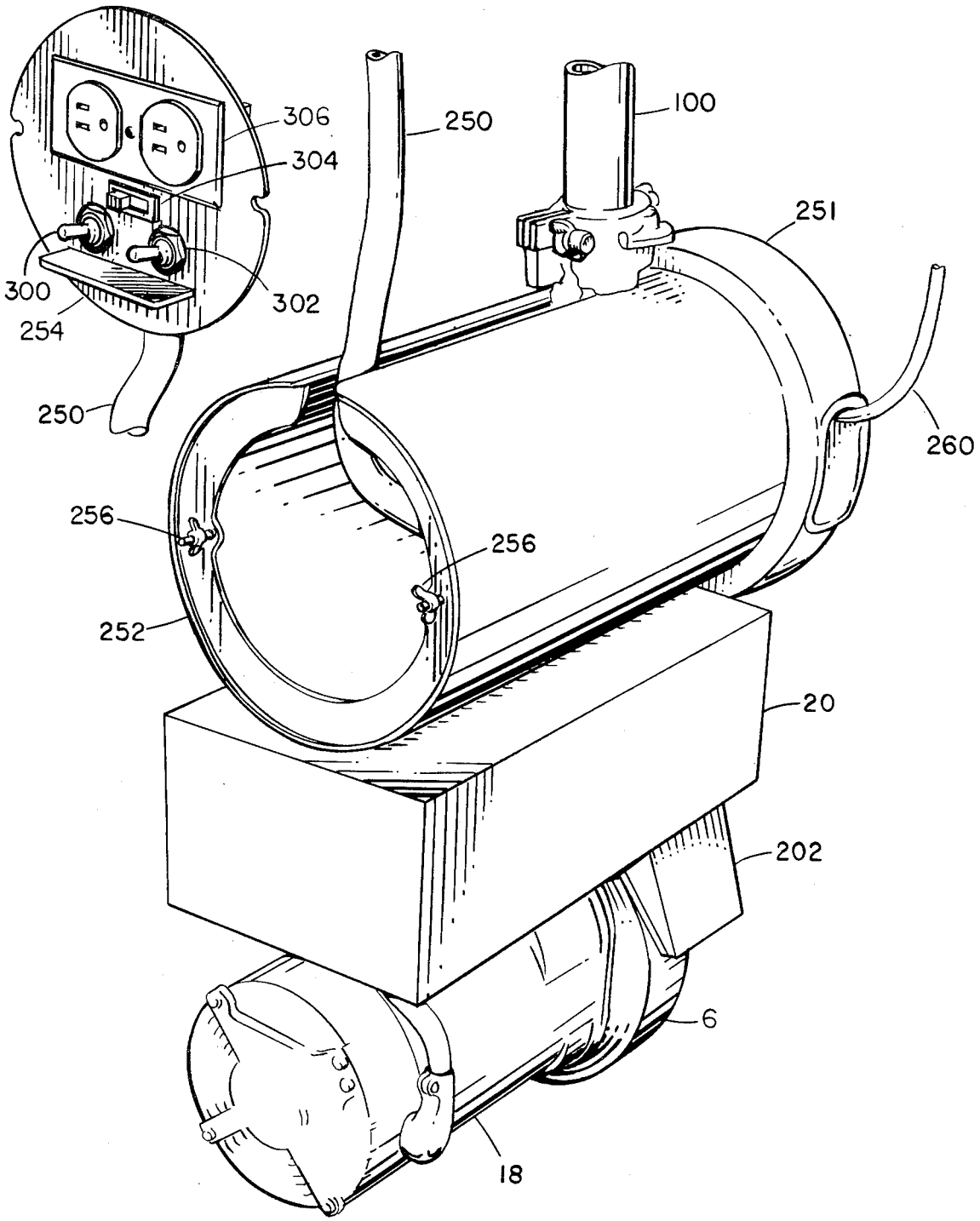
FIG. 2 is a perspective view of this scaffolding power unit as it is mounted on one leg of a scaffolding tower assembly with the turning assembly and cord storage units mounted directly above the drive motor; however the storage units may be mounted in any convenient position.

This power unit for attachment to a scaffolding tower assembly, referred to alternately as a power unit, or a scaffolding power unit, is comprised of four basic subassemblies which may be mounted in several configurations. The preferred embodiment, as shown in FIG. 2, consists of a drive unit and clutch assembly, a cord storage and control assembly, and a caster detainer assembly. Each of these components of the scaffolding power unit will be separately described with reference to the drawings.

Drive Unit and Clutch Assembly

Figure 5:
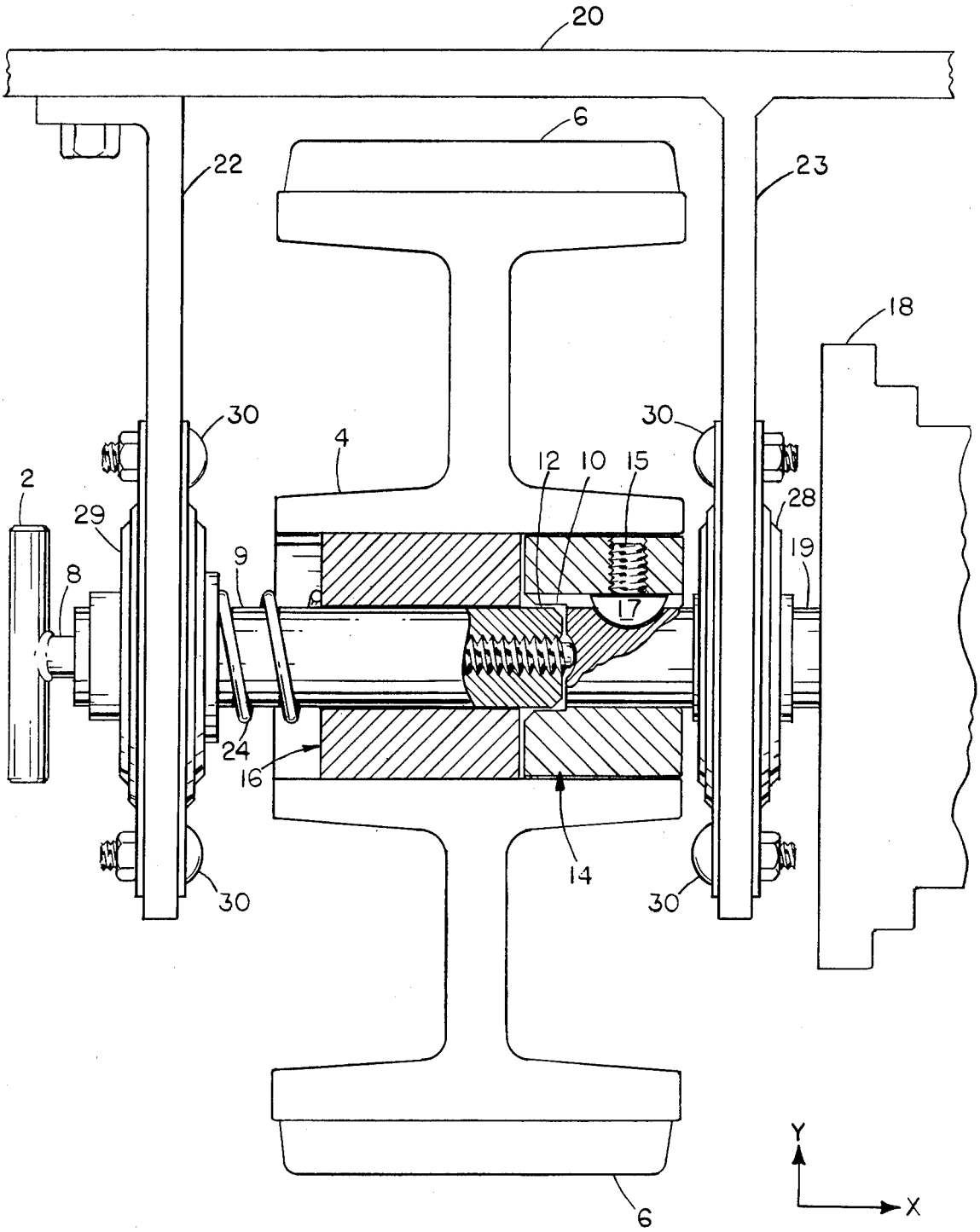
FIG. 5 is a front sectional view of the drive unit and clutch assembly, showing how a turn-screw pulls the wheel hub and drive wheel along the axle in order to disengage the rectangular tongue and groove locking members, thereby allowing the wheel hub and drive wheel to rotate freely.

Referring to FIG. 5, a gear reduction drive motor 18 turns a drive wheel 6 to provide for linear movement of the scaffolding power unit and attached scaffolding tower assembly. A clutch assembly inside the drive wheel hub 4 allows the drive wheel 6 to be disengaged from the drive motor 18, so that in case of need, the power unit and scaffolding assembly can be manually pushed about, such as during a power failure, for example.

The basic structural component of the scaffolding power unit is a main frame 20, in this preferred embodiment an aluminum rectangular box. Left and right drive wheel mounting fork members 22 and 23 respectively are secured to the bottom of main frame 20 and extend downward to form a drive wheel mounting fixture. A hole is provided near the lower end of both left and right drive wheel mounting fork members 22 and 23 to permit attachment of bearing assemblages 28 and 29, which are secured by four mounting bolts 30. Drive wheel axle 9 and drive shaft 19 extend through the bearing assemblages 28 and 29 to rotatably attach drive wheel 6 to left and right drive wheel mounting fork members 22 and 23. Mounting of the drive wheel axle 9 to the drive wheel 6 is accomplished by press fitting the drive wheel axle 9 to a drive wheel hub core 16 having a concentric hole throughout for this purpose and then press fitting this assemblage into the drive wheel hub 4.

The drive shaft 19 extends into a drive shaft hub core 14, and is secured therein by lock key 17 and set screw 15. Drive shaft hub core 14 is made slightly smaller than the interior diameter of the drive wheel hub 4, such that the drive shaft hub core 14 and attached drive shaft 19 are free to rotate with respect to the drive wheel 6 and also to move in and out of the hub 4 along the axis of the drive wheel axle 9.

Power transfer from the drive motor 18 to the drive wheel 6 is accomplished by a rectangular tongue and groove coupling method. The hub end of drive wheel axle 9 is machined or cast into a rectangular tongue 12, while the drive shaft hub core 14 has a matching rectangular groove 10. When the rectangular tongue 12 is fully inserted into the matching rectangular groove 10, then the drive shaft 19, drive shaft hub core 14, drive wheel axle 9, drive wheel hub core 16 and the drive wheel 6 all rotate as one unit and permit the transfer of torque from the drive motor 18 to the drive wheel 6.

The clutch mechanism operates by disengaging the tongue 12 from the groove 10, thereby permitting the drive wheel 6 to rotate freely without also turning drive motor 18.

Disengagement of the tongue 12 and groove 10 is accomplished by a spring biased turnscrew system. When turnscrew handle 2 is turned in the proper direction, turnscrew 8 applies pressure to drive shaft 19, forcing the drive wheel 6 to slide over the drive shaft hub core 14 in the direction away from the motor. A sufficient number of turns removes the tongue 12 from the groove 10. The action also puts a biasing spring 24 in compression, so that when the pressure exerted by turnscrew 8 is released by reversing the direction of rotation of turnscrew handle 2, the biasing spring 24 forces the tongue 12 back into the groove 10, thereby reengaging the drive motor 18 to the drive wheel 6.

The Turning and Scaffolding Tower Attachment Assembly

Figure 4:
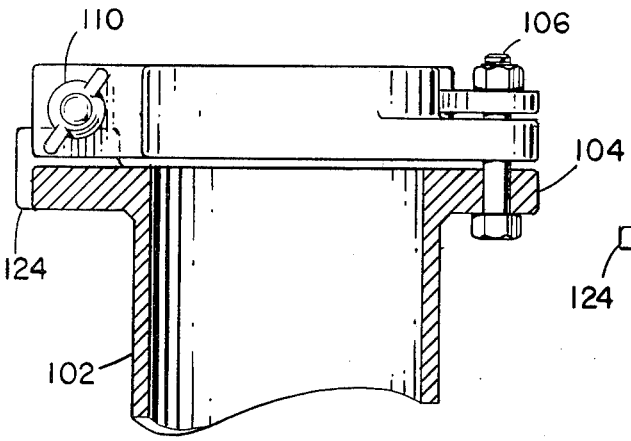
FIG. 4 is a side view of a ring clamp attachment means that secures the scaffolding leg into the first pipe.
Figure 4A:
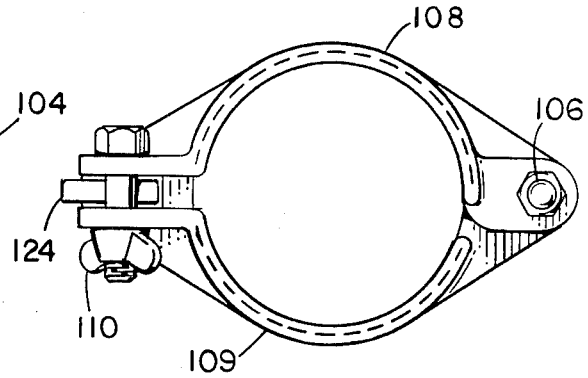
FIG. 4*a* is a top view of the ring clamp shown in FIG. 5 illustrating the hinge, tightening bolt, and stabilizing post.

The scaffolding tower leg 100 attaches to the scaffolding power unit by sliding down into an inner pipe 102 being secured therein by a ring clamp assembly 108 as shown in FIG. 3. The ring clamp assembly is mounted to a flange 104 on the inner pipe 102 as shown in FIGS. 3, 4, and 4*a*. The ring clamp assembly consists of two extending arms 108 and 109, which extend around the leg of the scaffolding tower 100. These extending arms 108, 109 are hinged by hinge bolt 106 and drawn together for firmly gripping the scaffolding tower leg 100 by a tightening bolt and wing nut 110. When tightened about the scaffolding tower leg 100 the two extending arms are secured to pipe 102 by the hinge bolt 106 and a stabilizing post 124 which prevents the clamp assembly from moving.

The inner pipe 102 rotatably fits within an outer pipe 112. The outer pipe 112 is rigidly attached to the scaffolding power unit at the main frame 20 and at the top of the cord storage drum 242. Within the main frame 20 the inner pipe 102 extends below the outer pipe 112 where a chain sprocket 114 is secured to the end of the inner pipe 102. Just above the chain sprocket 114 retaining bands 116 are attached around the pipe 102 by any convenient means, such as bolting, to eliminate any vertical slippage or movement of the inner pipe 102 within the outer pipe 112. Such slippage might occur when the scaffolding tower is crossing uneven terrain, allowing the scaffolding tower leg to which the scaffolding power unit is attached to be temporarily suspended in mid-air. Gravity would then cause the scaffolding power unit and the inner pipe 112 to which it is attached to fall until the bottom of the outer pipe 112 hits the chain sprocket 114. The retaining bands 116 effectively eliminate vertical movement of the scaffolding power unit relative to the attached scaffolding leg. The inner pipe 102 rests on thrust bearings 118, located just below the chain sprocket 114 and attached to the main frame 20. These thrust bearings 118 transfer the weight of the scaffolding tower leg 100 to the main frame 20 while still permitting the scaffolding power unit to rotate freely about the attached scaffolding tower leg 100. When energized, a gear reduction, directional motor 112 mounted to the main frame 120 applies a moment to the chain sprocket 114, and the attached inner pipe 102, through a linkage chain 120. Instead of the scaffolding tower leg 100 rotating under this moment however, the scaffolding power unit rotates about the scaffolding tower leg 100 due to its smaller moment and lower friction, thereby providing steering for the scaffolding power unit and attached scaffolding tower assemblage.

Caster Detainer Assembly

Figure 6:
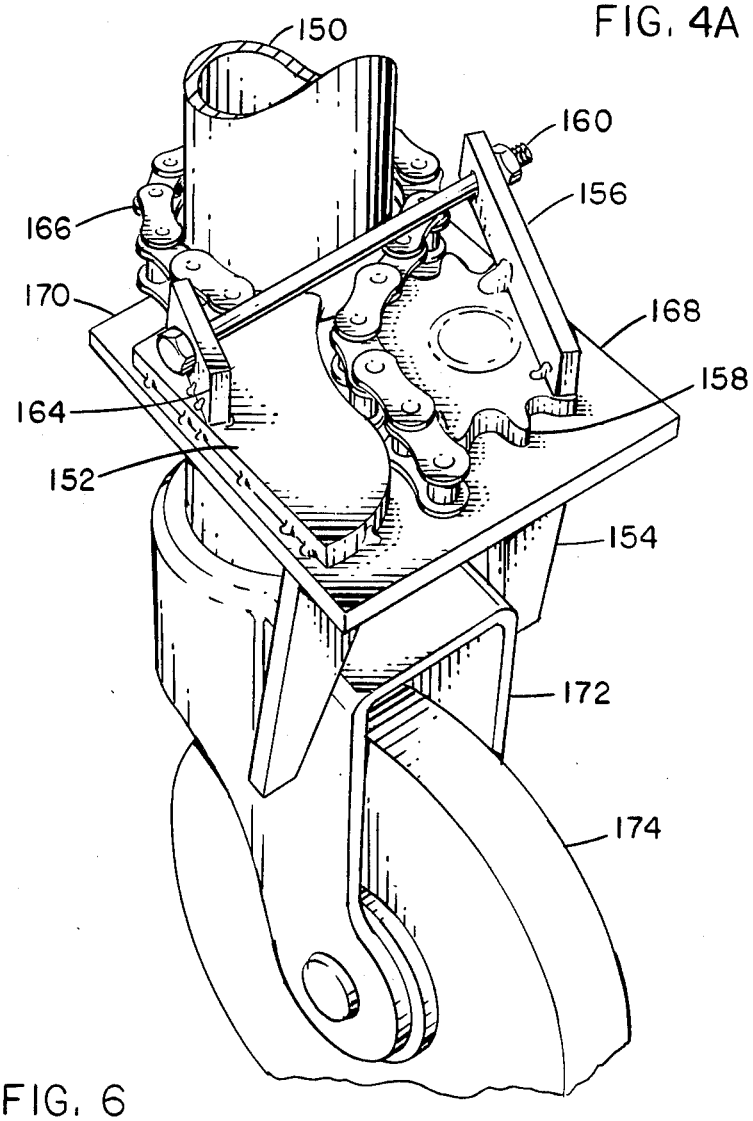
FIG. 6 is a perspective view of a caster and caster detainer assembly showing the chain mechanism that locks the detainer base plate and chain in place.

One or more caster detainer assemblies in FIG. 6 are often used to facilitate steering and maneuvering of the scaffolding power unit and attached scaffolding tower assemblage by preventing the rotation of the caster wheel 174 about the leg of the scaffolding tower assemblage. The caster detainer assembly is not necessary if the power units are used in tandem, and is often not necessary if only one power unit is used, but it may facilitate steering and maneuvering. The power unit may be tried on various legs of a large scaffolding tower, set up with and without one or more caster detainer assemblies mounted on other legs. Thus this scaffolding power unit is positioned to provide the best control and maneuverability of the scaffolding tower setup.

The caster detainer is made up of a base plate 168 which attaches in a plane parallel to the diameter of the scaffolding tower leg 150 and has a contoured edge on one end 170 to accommodate various sizes of scaffolding tower legs. Below and at right angles to this base plate 168 depends a forked yoke 154, which extends on either side of the caster wheel 174. When the caster detainer assembly is secured to the scaffolding tower leg 150, rotation of the caster wheel 174 around the scaffolding tower leg 150 is restrained by contact on either side with the forked yoke 154.

A chain clamp mounted to the top of the base plate 168 securely fastens the caster detainer assembly to the scaffolder tower legs 150. A chain sprocket 158 is rotatably mounted to the base plate 168. In close proximity to the chain sprocket is mounted a chain retaining plate 152 which provides a channel for the chain 166 and prevents it from slipping off the chain sprocket 158. A chain sprocket lever 156 with a hole in one end is fastened to the chain sprocket 158. A tensioning bolt 160 passes through the hole on the chain sprocket lever 156 and a tensioning bolt securing block 164, mounted on the chain retaining plate 152. A nut on the tensioning bolt 162 places the tensioning bolt in tension between the chain sprocket lever 156 and the tensioning bolt securing block 164. One end of the chain 166 is attached to the chain retaining plate 152. When the chain is passed around the scaffolding tower leg 150 and into the chain sprocket, as shown in FIG. 6, the tensioning bolt 160 exerts a force on the chain sprocket lever 156, such that the chain 166 tightens around the scaffolding tower leg 150, thereby firmly locking the caster detainer assembly to the scaffolding tower leg 150.

The Brake Assembly

Figure 7:
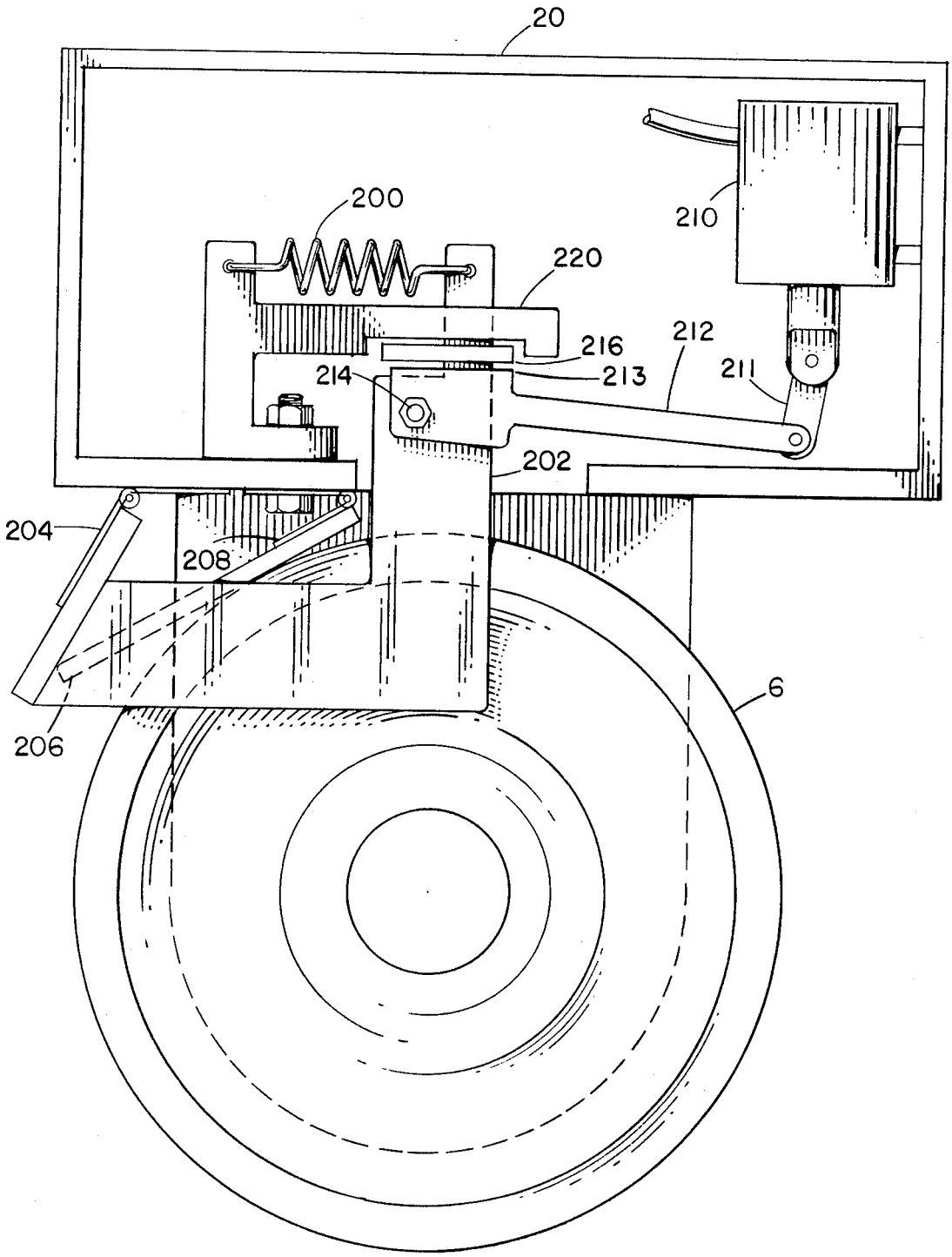
FIG. 7 is a side view of the brake mechanism used to lock the drive wheel when the scaffolding power unit is not in operation.

The brake assembly shown in FIG. 7 binds the drive wheel 6 so that it cannot move any time the drive motor 18 is not in operation. In the braking position a spring 200 exerts a force on a brake bar 202 placing a counter clockwise moment on it about brake bar hinge 204. The brake bar 202 then contacts brake pad 206 causing it to exert a counter clockwise moment about the brake pad hinge 208 and contact the drive wheel 6. When the drive motor 18 is in operation the brake releases by energizing solenoid 210 which pulls upward on brake release lever 212 through linkage 211. Brake release lever 212 rotates in a counter clockwise direction about the hinge bolt 214, until the corner 213, diagonally opposite the hinge bolt 214, contacts the bearing slider 216. The corner 213 then becomes a fulcrum, about which rotates the brake release lever 212, which applies a downward force to brake bar 202, causing a clockwise rotation of brake bar 202 about brake bar hinge 204, thereby removing the contact pressure between the brake bar 202 and the brake pad 206, which unbinds the drive wheel 6 and allows it to turn. Bearing slider 216, slidably mounted to brake frame 220, permits lateral movement of brake release bar 212 and attached brake bar 202.

During freewheeling operations with the drive wheel disengaged from the drive motor by the action of the clutch assembly, the brake may be manually pulled back from the drive wheel and locked in this position to permit the drive wheel to rotate freely.

Cord Storage and Control Unit

An electrical control cord connects the scaffolding power unit with the control unit that operates the directional and drive motors. A power cord supplies power to the directional and drive motors. For convenience, each of these cords have their own storage units mounted to the main frame 20.

In the preferred embodiment shown in FIGS. 2 and 4, the control cord 250 is manually coiled in cord storage drum 252 when not in use. After all the control cord 250 is coiled in the cord storage drum 252 the control unit 254 may be secured with screws 256 to the end of the cord storage drum 252 for convenient storage. A spring windup power cord storage reel 251 is mounted to the end of the control cord drum 252 for storing the power cord 260 when not in use.

Although the cord storage drum 252 is shown in the preferred embodiment of FIGS. 2 and 4 as being mounted on top of main frame 20, it may be mounted on the side of main frame 20, if additional clearance is necessary, as in the case of inadequate free length of a scaffolding tower leg.

The control unit 254 is made of a utility connection box 262 fastened to an aluminum plate 264. In the plate are mounted two toggle switches 300, 302, a kill switch 304, and a power outlet 306. One toggle switch 300 controls the directional motor 122 and the direction of rotation of the power unit about the scaffolding tower leg 100. The other toggle switch 302 controls the drive motor 18 and the direction of rotation of the drive wheel 6. Each switch is a three position momentary contact switch which automatically returns to the off position when released. A kill switch 304 removes all power to the scaffolding power unit and is added as a safety measure. The power outlet 306 allows the convenient use of power hand tools by workers on the scaffolding tower platform.

Figure 8:
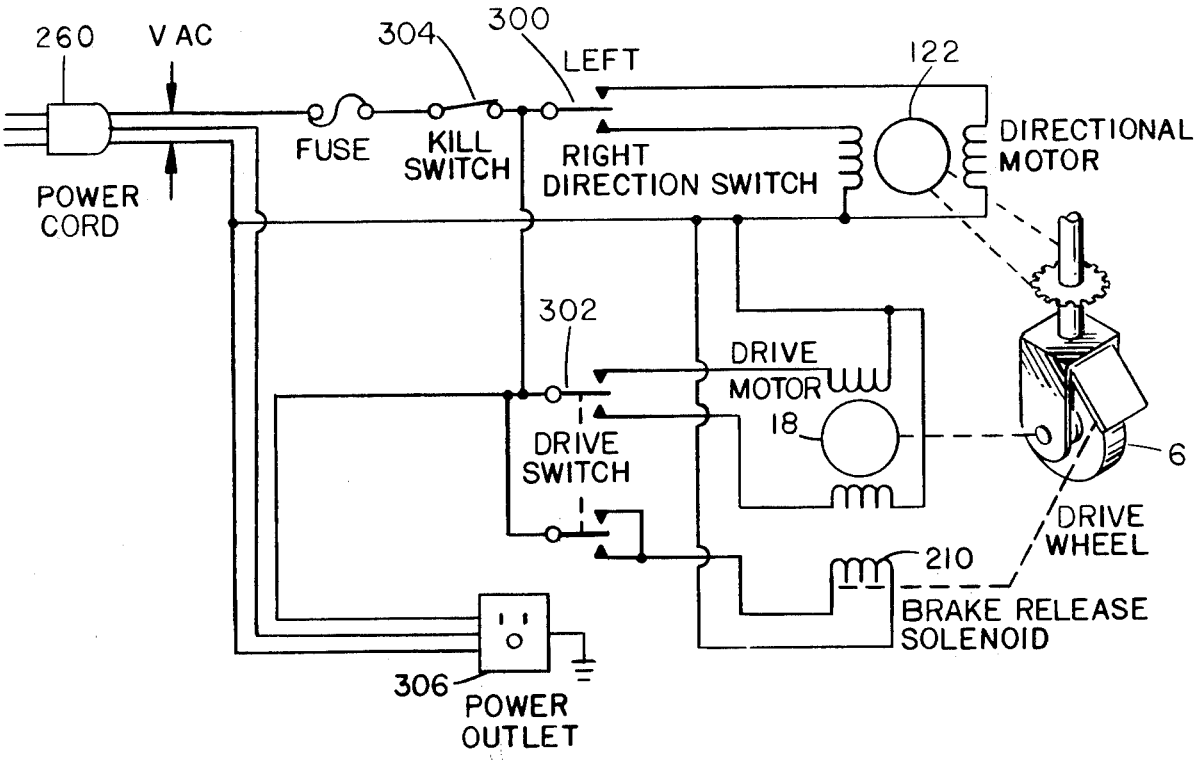
FIG. 8 is a schematic diagram of the circuitry used to control and provide power to the directional and drive motors 122 and 18 respectively and brake release solenoid 210.

The circuit diagram of FIG. 8 illustrates the switch connections to the directional and drive motors 122 and 18 respectively and the brake release solenoid 210. Note that whenever the drive motor 18 is actuated, brake release solenoid 210 is also actuated.

In respect to the control unit and the control cord, a lower voltage control circuit could be utilized, with a transformer, to reduce the incoming voltage of 120 volts down to a control voltage of 24 volts. Such a lower voltage control circuit protects an operator from any possible shocks at a higher voltage.

I claim:

1. A scaffolding power unit for attachment to scaffolding tower assemblages of the type commonly used for overhead finishing work in the installation of wiring, lighting fixtures, duct work and ceilings, which have detachable caster wheels so they may be rolled from place to place, the scaffolding unit comprising:

(a) a main frame;

(b) a pivotal attachment means connected to the main frame which pivotally attaches the scaffolding power unit to a single leg of the scaffolding tower assemblage;

(c) a drive wheel, rotatably attached to the main frame;

(d) a propelling means connected to the drive wheel which provides for linear motion of the scaffolding power unit and the attached scaffolding tower assemblage; and (e) a clutch means, such that the propelling means may be disengaged from the drive wheel to rotate freely so the scaffolding tower may be manually rolled from place to place, comprising:

(1) also the said drive wheel;

(2) a drive wheel axle, concentrically attached to the drive wheel, having a threaded interior throughout and having one part of a tongue and groove mating system on the end attached to the drive wheel;

(3) a drive shaft, slidably attached to the drive wheel and having the complementary part of the tongue and groove mating system on the end slidably attached to the drive wheel, such that when the tongue and groove mating system is engaged the drive shaft, the drive wheel axle and the drive wheel rotate together;

(4) a turnscrew, threaded through the interior of the drive wheel axle, such that one end contacts the end of the drive shaft;

(5) a biasing spring; and (6) a turnscrew handle, attached to the turnscrew, such that turning the turnscrew handle in one direction causes the end of the turnscrew to push against the end of the drive shaft, thereby separating the drive shaft and the drive wheel axle, such that the tongue and groove mating system is disengaged, permitting the drive wheel to rotate freely with respect to the drive shaft, while turning the turnscrew handle in the other direction releases the pressure of the turnscrew against the end of the drive shaft, thereby permitting the biasing spring to push the drive shaft and drive wheel axle back together, thereby reengaging the tongue and groove mating system.

2. A scaffolding power unit for attachment to scaffolding tower assemblages, as claimed in claim 1, further comprising, a directional drive means, which pivots the power unit about the pivotally attached leg of the scaffolding tower assemblage, thereby providing directional change of the linear motion of the scaffolding power unit and attached scaffolding tower assemblage.

3. A scaffolding power unit for attachment to scaffolding tower assemblages of the type commonly used for overhead finishing work in the installation of wiring, lighting fixtures, duct work and ceilings, which have detachable caster wheels so they may be rolled from place to place, the scaffolding power unit comprising:

(a) a main frame;

(b) a pivotal attachment means connected to the main frame which pivotally attaches the scaffolding power unit to a single leg of the scaffolding tower assemblage;

(c) a drive wheel, rotatably attached to the main frame;

(d) a propelling means connected to the drive wheel which provides for linear motion of the scaffolding power unit and the attached scaffolding tower assemblage; and (e) a brake means, such that the drive wheel is restrained from rotation when the scaffolding power unit is not being used to move the scaffolding tower assemblage, comprising:

(1) also the said main frame;

(2) a brake release lever;

(3) a brake bar pivotally attached at the one end to the brake release lever and pivotally attached at the other end to the main frame;

(4) a brake pad, pivotally attached to the main frame and contacting the brake bar on one side such that rotation of the brake bar in one direction forces the brake pad against the drive wheel, thereby preventing the drive wheel from rotating, while rotation of the brake bar in the other direction releases the pressure on the brake pad, thereby freeing the drive wheel for rotation;

(5) a spring, attached at one end to the main frame and at the other end to the brake bar, such that it exerts a force on the brake bar, causing it to rotate, thereby pushing the brake pad against the drive wheel; and (6) a solenoid, pivotally attached to the brake release lever, such that energizing the solenoid overcomes the force of the spring and removes the brake pad from contact with the drive wheel, thereby permitting rotation of the drive wheel.

4. A scaffolding power unit for attachment to scaffolding tower assemblages, as claimed in claim 3, further comprising a directional drive means, which pivots the power unit about the pivotally attached leg of the scaffolding tower assemblage, thereby providing directional change of the linear motion of the scaffolding power unit and attached scaffolding tower assemblage.

5. A scaffolding power unit for attachment to scaffolding tower assemblages of the type commonly used for overhead finishing work in the installation of wiring, lighting fixtures, duct work and ceilings, which have detachable caster wheels so they may be rolled from place to place, the scaffolding power unit comprising:

(a) a main frame;

(b) a pivotal attachment means connected to the main frame which pivotally attaches the scaffolding power unit to a single leg of the scaffolding tower assemblage, comprising:

(1) an inner cylinder into which the scaffolding tower leg fits once the caster wheel is removed;

(2) an outer cylinder in which the inner cylinder is rotatably mounted and which is fixed to the main frame of the scaffolding power unit; and (3) a means attached to the inner cylinder for removably securing the inner cylinder to the scaffolding tower leg;

(c) a drive wheel, rotatably attached to the main frame; and (d) a propelling means connected to the drive wheel which provides for linear motion of the scaffolding power unit and the attached scaffolding tower assemblage.

6. A scaffolding power unit for attachment to scaffolding tower assemblages, as claimed in claim 5, wherein the means attached to the inner cylinder for removably securing the inner cylinder to the scaffolding tower leg comprises:

(a) a flange attached to the inner cylinder;

(b) extending arms, pivotally attached to the flange and extendable around the scaffolding tower leg; and (c) a tightening means, for drawing the extending arms into contact with the scaffolding tower leg, such that the scaffolding tower leg is securely fastened to the inner cylinder.

7. A scaffolding power unit for attachment to scaffolding tower assemblages of the type commonly used for overhead finishing work in the installation of wiring, lighting fixtures, duct work and ceilings, which have detachable caster wheels so they may be rolled from place to place, the scaffolding power unit comprising:

(a) a main frame;

(b) a pivotal attachment means connected to the main frame which pivotally attaches the scaffolding power unit to a single leg of the scaffolding tower assemblage;

(c) a drive wheel, rotatably attached to the main frame;

(d) a propelling means connected to the drive wheel which provides for linear motion of the scaffolding power unit and the attached scaffolding tower assemblage; and (e) means for preventing the rotation of at least one of a plurality of casters about the longitudinal axis of the scaffolding tower leg to which the caster is attached, comprising:

(1) a base plate;

(2) a forked yoke, attached to the base plate;

(3) a chain sprocket pivotally attached to the base plate;

(4) a lever having holes in one end attached to the chain sprocket;

(5) a chain, attached at one end to the base plate and of sufficient length to extend around the scaffolding tower leg and engage the chain sprocket; and (6) a tensioning bolt, secured at one end to the base plate and extending through the hole in the lever, such that force applied by the tensioning bolt to the lever causes the chain sprocket to rotate, thereby tightening the chain around the scaffolding tower leg.

* * * * *